United States Patent [19]

Kern

[11] 4,454,625

[45] Jun. 19, 1984

[54] CHIMNEY CLEANING APPARATUS

[76] Inventor: Ernest J. Kern, 319 SE. 98th Ave., Vancouver, Wash. 98664

[21] Appl. No.: 381,214

[22] Filed: May 24, 1982

[51] Int. Cl.[3] ..... F23J 3/00

[52] U.S. Cl. ..... 15/249; 15/243

[58] Field of Search ..... 15/163, 243, 246.5, 15/249; 134/8

[56] References Cited

U.S. PATENT DOCUMENTS

| | | |
|---|---|---|
| 1,305,543 | 6/1919 | Hinman . |
| 1,422,001 | 7/1922 | Sharp et al. . |
| 1,515,410 | 11/1924 | Renner . |
| 2,293,847 | 8/1942 | Pearson . |
| 3,120,020 | 2/1964 | Schell . |

*Primary Examiner*—Edward L. Roberts

*Attorney, Agent, or Firm*—Eugene M. Eckelman

[57] ABSTRACT

A base frame is arranged to be supported at the top of a chimney and has a support arm which extends over the top of the chimney opening. A crank is provided on the support arm, and an elongated flexible member hangs from the crank whereby upon turning the crank the flexible member swings around inside the chimney to knock off collected substance. The crank is arranged to be driven by an operating rod extending to a remote area, such as to the ground, whereby operation of the crank can be accomplished from the ground. In a modification of the apparatus, an electric motor may be supported on the base frame for providing the drive for the crank.

7 Claims, 2 Drawing Figures

CHIMNEY CLEANING APPARATUS

BACKGROUND OF THE INVENTION

This invention relates to new and novel chimney cleaning apparatuses.

As is well known, chimneys require cleaning at periodic intervals to remove substances collected on the inner surface thereof due to incomplete combustion. Such is particularly true of wood and coal stoves in view of the combustion inefficiency thereof and a hazard from chimney fires is created in the event that the collected substance is not removed. It is customary to remove such collected substance by brushes or other means whereby the removed substance falls to a lower point for collection. Such cleaning functions must be accomplished without a fire in the heating unit.

Many units now comprise fireplace inserts which include a stove-like member installed in a conventional fireplace and which use the fireplace flue as the draft for the stove. Cleaning the chimney in those cases involving inserts usually requires that the insert be removed since otherwise the substance cleaned from the chimney will drop down and collect behind the insert and create extreme danger from fire in the event the collected substance should become ignited.

SUMMARY OF THE INVENTION

According to the present invention and forming a primary objective thereof, a chimney cleaning apparatus is provided that has the advantage of being operable with a fire in the heating unit whereby not only can a better cleaning job be accomplished but at the same time it is not required that the heating unit be shut down. Also, insert type heating units do not have to be removed during the cleaning function.

A more particular object of the invention and one which accomplishes the above general objectives is to provide a cleaning apparatus that is arranged to be supported on the top of the chimney and has drive means capable of being operated from a remote area, such as from the ground. A fire can thus be maintained in the heating unit at the time of cleaning and the draft from the fire will blow the removed substance up and out of the chimney.

Another object of the invention is to provide a chimney cleaning apparatus of the type described which is inexpensive to manufacture and simplified in operation.

In carrying out the objectives, the invention comprises a base frame arranged to be supported at the top of a chimney. The base frame has a support arm arranged to be disposed over the top of the chimney opening. A crank is provided on the support arm and supports an elongated flexible member, such as a chain, arranged to hang down inside the chimney whereby upon turning the crank the flexible member swings around the inside the chimney and knocks off collected substances on the inner surface of the chimney. Drive means are provided for rotating the crank, and remote operating means are associated with the drive means for operating the latter from a remote point such as from the ground. The drive means may comprise either a manually operated rod or an electric motor supported on the frame. The flexible link is slidably adjustable on the crank for adjustment to reach corners of non-round chimneys.

The invention will be better understood and additional objectives and advantages will become apparent from the following description taken in connection with the accompanying drawings.

DETAILED DESCRIPTION OF PREFERRED EMBODIMENTS

Figure 1:
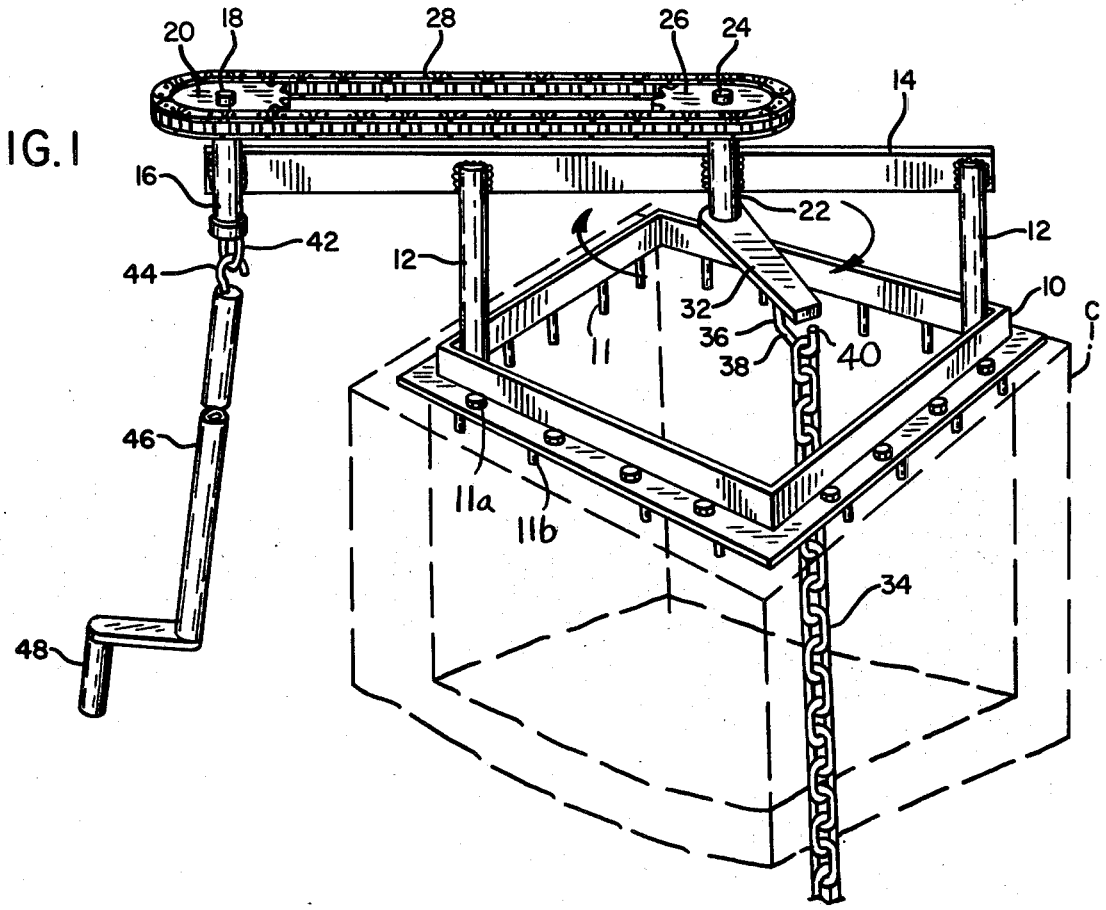
FIG. 1 is a perspective view of the present chimney cleaning apparatus, this view showing a first form of drive.

With particular reference to the drawings, the chimney cleaning apparatus of the invention comprises an open center base frame 10 of a suitable dimension so as to seat on the top of a chimney C. The frame supports a plurality of right angle keys 11 having threaded engagement with cap screws **11*a* passing freely through the frame. Depending legs 11*b* of the keys are arranged to engage the inner surface of the chimney and are adjustable to different size chimneys by clamping them in selected rotated position by the cap screws. Two corner posts 12 disposed in diagonal relation on the frame extend up above the frame 10 and support a cross arm 14 one end of which extends beyond the frame and supports an upright housing 16 for a shaft 18 having a sprocket wheel 20 keyed to its upper end. A second shaft housing 22 is secured to the cross arm 14 intermediate its supporting posts 12 whereby to be substantially centralized over the chimney opening. Shaft housing 22 rotatably supports an upright shaft 24 having a sprocket wheel 26 secured to its upper end. Sprocket wheels 20 and 26 are interconnected by a sprocket chain 28**.

The bottom end of shaft 24 has a crank arm 32 secured thereto arranged to support a chain 34 in depending relation down the chimney. The arm 32 is of a selected length so that when rotated the chain 34 will slap against the inner surface of the chimney and knock off the collected substances such as soot and creosote. The chain may be of suitable length to reach the desired distance down into the chimney. It is to be understood that other flexible members may be used in place of a chain such as a flexible cable or the like.

In a preferred arrangement, the chain has adjustable movement along the length of the crank arm 32, and for this purpose the crank arm has a depending eye 36 with a straight bottom portion 38 on which the top link of the chain 34 is slidably supported. Upon rotation of the crank arm, the chain will be moved outwardly by centrifugal force to reach corner portions of non-round chimneys. As the chain engages side wall portions of the chimney it will move inwardly along the eye 36 and thus in all rotative movements of the chain it will hang substantially straight down to accomplish an efficient cleaning function. The outer end 40 of the eye 36 is open for easy attachment and removal of the chain.

With reference to FIG. 1, shaft 18 has an eye 42 on the bottom thereof arranged to be engaged by a hook 44 on the end of a long rod 46 having a crank handle 48 adjacent the bottom thereof. Rod 46 may be of sufficient length to extend from the top of the chimney to the ground so that shaft 18 and therefore crank arm 32 can be operated from the ground. The hook end 44 on the rod 46 allows it to be hooked into the eye 42 when it is desired to clean the chimney but to be removed and stored in an out-of-the-way place when not in use.

Figure 2:
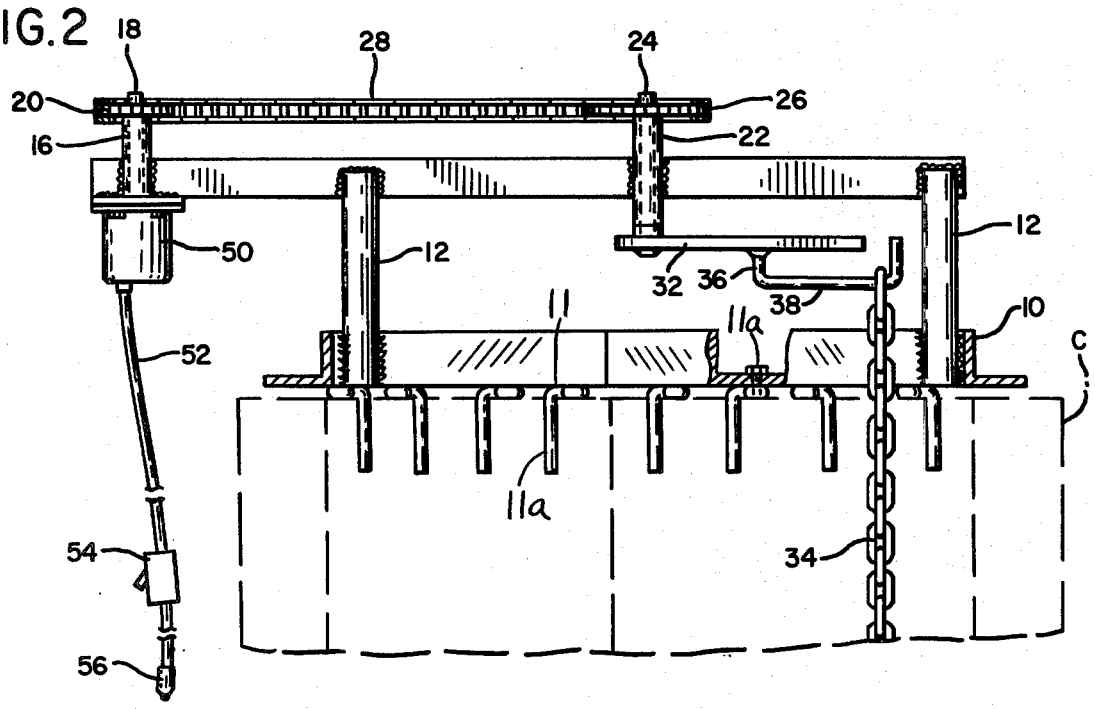
FIG. 2 is a cross sectional view thereof, this view showing a modified form of drive.

With reference to FIG. 2, power drive may be provided for the shaft 18, and for this purpose a small low voltage electric motor 50 may be secured to the bottom end of the shaft 18. Suitable wiring 52 is provided with control means 54 preferably located adjacent the ground for remote operation of the apparatus for the intended purpose described in connection with the FIG. 1 embodiment. Motor 50 may comprise a 12 volt DC motor and thus could be operated from a vehicle battery. It may include a plug-in end 56 so as to conveniently obtain power from the cigarette lighter of a vehicle.

In accordance with the invention, the apparatus will remain seated on the chimney and when it is desired to clean the chimney, the rod 46 of FIG. 1 is merely hooked into the eye 42 and turned sufficiently, or the motor 50 of FIG. 2 energized, to knock off the collected substances on the inner surface of the chimney. Since the apparatus can be operated from a remote area, the chimney can be cleaned in a highly efficient manner because a fire can be maintained in the heating unit at the time of cleaning so that substance knocked off the inner surface of the chimney will be blown out the top by the draft up the chimney. It will thus not be necessary to collect the removed substance from a lower area of the chimney, and also if a fireplace insert is used it is not necessary to remove such insert prior to cleaning.

It is to be understood that the forms of my invention herein shown and described are to be taken as preferred examples of the same and that various changes in the shape, size and arrangement of parts may be resorted to without departing from the spirit of my invention, or the scope of the subjoined claims.

Having thus described my invention, I claim:

1. Chimney cleaning apparatus comprising (a) a base frame arranged to be secured to the top of a chimney, (b) a support arm on said frame arranged to be disposed over the top of the chimney opening, (c) a crank on said support arm, (d) drive means for rotating said crank, (e) an elongated flexible member secured to said crank and arranged to hang down inside a chimney whereby upon turning said crank said flexible member swings around inside the chimney to knock off any substance which may have collected on the inner surface of the chimney, (f) and operating means for said drive means arranged to manually control the operation of said drive means from a point remote from the chimney supported apparatus.

2. Chimney cleaning apparatus comprising (a) a base frame arranged to be supported at the top of a chimney, (b) a support arm on said frame arranged to be disposed over the top of the chimney opening, (c) an upright driven shaft on said support arm, (d) a crank on the lower end of said shaft, (e) an elongated flexible member secured to said crank and arranged to hang down inside a chimney whereby upon turning said crank said flexible member swings around inside the chimney to knock off any substance which may have collected on the inner surface of the chimney, (f) said support arm projecting laterally beyond a portion of said base frame, (g) a drive shaft on said projecting portion of said base frame, (h) means rotatably connecting said drive and driven shafts, (i) drive means for said drive shaft, (j) and operating means for said drive means arranged to operate said drive means from a point remote from the chimney supported apparatus.

3. The chimney cleaning apparatus of claim 2 wherein said remote operating means comprises a manually rotatable rod removably connectable to said drive shaft whereby said drive shaft and said crank are manually driven from said remote point by rotating said rod.

4. The chimney cleaning apparatus of claim 2 wherein said remote operating means comprises a manually rotatable rod removably connectable to said drive shaft whereby said drive shaft and said crank are manually driven from said remote point by rotating said rod, said rod being of sufficient length to extend down to the ground whereby the crank can be operated from ground level.

5. The chimney cleaning apparatus of claim 2 wherein said remote operating means comprises a manually rotatable crank rod removably connectable to said drive shaft whereby said drive shaft and said crank are manually driven from said remote point by rotating said rod, said rod being of sufficient length to extend down to the ground whereby the crank can be operated from ground level.

6. The chimney cleaning apparatus of claim 2 wherein said remote operating means comprises an electric motor secured to said drive shaft and switch operating means for said motor located so as to operate said motor from ground level.

7. Chimney cleaning apparatus comprising (a) a base frame arranged to be supported at the top of a chimney, (b) a support arm on said frame arranged to be disposed over the top of the chimney opening, (c) a crank on said support arm, (d) drive means for rotating said crank, (e) an elongated flexible member secured to said crank and arranged to hang down inside a chimney whereby upon turning said crank said flexible member swings around inside the chimney to knock off any substance which may have collected on the inner surface of the chimney, (f) said flexible link being slidably adjustable on said crank for adjustment back and forth on said crank to reach corners of non-round chimneys, (g) and operating means for said drive means arranged to operate said drive means from a point remote from the chimney supported apparatus.

* * * * *